US007368047B2

(12) United States Patent
Park

(10) Patent No.: US 7,368,047 B2
(45) Date of Patent: May 6, 2008

(54) METHOD OF PREPARING COPPER PLATING LAYER HAVING HIGH ADHESION TO MAGNESIUM ALLOY USING ELECTROPLATING

(76) Inventor: Byung Chul Park, 106-102, Samsung Heitz, Jakjeon-dong 706-14, Kyeyang-gu, Incheon (KR)

( * ) Notice: Subject to any disclaimer, the term of this patent is extended or adjusted under 35 U.S.C. 154(b) by 64 days.

(21) Appl. No.: 11/350,911

(22) Filed: Feb. 10, 2006

(65) Prior Publication Data

US 2007/0108060 A1 May 17, 2007

(30) Foreign Application Priority Data

Nov. 11, 2005 (KR) ..... 10-2005-0107799

(51) Int. Cl.
*C25D 5/10* (2006.01)
*C25D 5/34* (2006.01)

(52) U.S. Cl. ..... 205/182; 205/210
(58) Field of Classification Search ..... 205/210, 205/238, 314, 182
See application file for complete search history.

(56) References Cited

U.S. PATENT DOCUMENTS 2,661,329 A * 12/1953 De Long ..... 148/666
4,349,390 A * 9/1982 Olsen et al. ..... 148/252
6,790,265 B2 * 9/2004 Joshi et al. ..... 106/1.17
2007/0039829 A1 * 2/2007 Pearson et al. ..... 205/177

* cited by examiner

*Primary Examiner*—Edna Wong
(74) *Attorney, Agent, or Firm*—Greenblum & Berstein, P.L.C.

(57) ABSTRACT

Disclosed is a method of preparing a copper electroplating layer having high adhesion to a magnesium alloy, which is advantageous because the usability of the magnesium alloy, having the highest specific strength among actually usable metals, can be increased through the development of a process of forming a uniform copper plating layer upon electroplating of the magnesium alloy. The method of preparing a copper electroplating layer having high adhesion to a magnesium alloy of this invention is characterized in that the magnesium alloy is pretreated with a plating pretreatment solution to form a film for electroplating, serving as a magnesium alloy pretreatment layer, exhibiting a uniform current distribution, which is then electroplated with copper to form the copper plating layer. According to this invention, through the pretreatment of the magnesium alloy, the adhesion of the copper plating layer to the film for electroplating formed on the magnesium alloy can be increased.

8 Claims, 8 Drawing Sheets

Prior Art

Prior Art

Prior Art

METHOD OF PREPARING COPPER PLATING LAYER HAVING HIGH ADHESION TO MAGNESIUM ALLOY USING ELECTROPLATING

BACKGROUND OF THE INVENTION

1. Field of the Invention

The present invention relates, generally, to a pretreatment method of a magnesium alloy for electroplating the magnesium alloy, and more particularly, to a method of pretreating a magnesium alloy to electroplate the magnesium alloy so as to increase the usability of the magnesium alloy, having the highest specific strength among actually usable metals, through the development of a magnesium pretreatment process for the formation of a uniform copper (Cu) electroplating layer on the magnesium alloy.

2. Description of the Related Art

In general, a magnesium (Mg) alloy, which has the smallest weight among actually usable metals, has excellent specific strength (specific gravity/strength) and easy processability, and is thus widely used for parts of automobiles, computers, or information communication apparatuses. Although the magnesium alloy has been prepared mainly using a die casting process, an extrusion process, a rolling process, etc., it is recently formed using a thixo-molding process as an advanced technique by a combination of metal die casting and plastic injection molding. With the development of magnesium alloys able to undergo press forming, the demand thereof will increase more and more.

However, since the magnesium alloy has a relatively low standard potential among the actually usable metals, it may be easily oxidized in air, thus having corrosion resistance insufficient for use as an actually usable metal. Thus, great efforts have been made to increase the corrosion resistance of the magnesium alloy.

As surface treatment techniques for improvements in corrosion resistance of the magnesium alloy, a chromate treatment process has been widely conducted. However, the chromate treatment suffers because it discolors the surface of magnesium and a chromium compound of a solution used for chromate treatment causes environmental problems, and thus the use thereof is limited according to international environmental restrictions.

Therefore, although the development of non-chromate treatment has been actively conducted in recent years, such non-chromate treatment results in lower corrosion resistance and higher expense than those of the conventional chromate treatment.

In addition, an anodizing process has been developed, but it is limitedly used for internal parts where external appearance is not regarded as important or is applied only to under-films of coating or painting.

As the other surface treatment for an increase in corrosion resistance of the magnesium alloy, techniques for plating a surface of a magnesium alloy using a dry or wet process are proposed. However, the magnesium alloy is difficult to dry plate, including deposition plating in a vacuum, due to the high vapor pressure thereof.

The wet plating techniques are classified into a wet electroplating process using electrical energy, and an electroless plating process using a chemical reaction. As such, the electroless plating process is exemplified by an electroless nickel plating process. However, the electroless nickel plating process is disadvantageous because an electroless nickel plating solution has high production cost, and as well an electroless nickel plating layer should be double-, triple- or quadruple-formed while varying the amounts of phosphorus (P) to increase the corrosion resistance of magnesium.

SUMMARY OF THE INVENTION

Accordingly, the present invention has been made keeping in mind the above problems occurring in the related art, and an object of the present invention is to provide a method of forming a copper plating layer having high adhesion to a magnesium alloy through electroplating, in which a film for electroplating is formed on the magnesium alloy and then copper (Cu) plating is conducted, such that the magnesium alloy, which is susceptible to an acid, in particular, an aqueous sodium chloride solution, can have high corrosion resistance, therefore resulting in increased usability of the magnesium alloy.

Further, the present invention, aiming to be a method of preparing a copper electroplating layer having high adhesion to a magnesium alloy, is characterized in that the magnesium alloy is pretreated with a plating pretreatment solution to form a film for electroplating, serving as a magnesium alloy pretreatment layer, exhibiting a uniform current distribution, which is then electroplated with copper to form the copper plating layer.

In order to accomplish the above object, the present invention provides a method of preparing a copper plating layer having high adhesion to a magnesium alloy through electroplating, comprising pretreating the magnesium alloy with a plating pretreatment solution to form a film for electroplating, serving as a magnesium alloy pretreatment layer, exhibiting a uniform current distribution; and conducting copper electroplating on the magnesium alloy treatment layer to form the copper plating layer firmly adhering to the magnesium alloy pretreatment layer, in which, upon separation of the copper plating layer by force, the surface of the magnesium alloy adhering to the copper plating layer exhibits coarse grains contained in the pretreatment layer.

In addition, in the method of the present invention, the plating pretreatment solution may comprise 5~130 g/l of $ZnSO_4$, 30~450 g/l of $Na_4P_2O_7$, 4~100 g/l of KF, and 2~100 g/l of $Na_2CO_3$.

In addition, in the method of the present invention, each of $K_4P_2O_7$ and $Na_2CO_3$ may be used in an amount of about 5~20 vol % based on a volume of a solution of a dry bath when chemical components of the plating pretreatment solution have fatigue due to frequent plating, in order to continuously maintain adhesion between the copper plating layer and magnesium alloy.

In addition, in the method of the present invention, the plating pretreatment solution may comprise 4~145 g/l of $ZnSO_4$, 15~450 g/l of $Na_4P_2O_7$, 1~125 g/l of NaF, 1~125 g/l of $Na_2CO_3$ and 0.5~45 g/l of $KNaC_4H_4O_6$, with additives.

In addition, in the method of the present invention, the plating pretreatment solution may comprise 5~80 g/l of $ZnSO_4$, 4~380 g/l of $K_4P_2O_7$, 5~80 g/l of KF, and 2~120 g/l of $Na_2CO_3$.

In addition, in the method of the present invention, the plating pretreatment solution may comprise 7~220 g/l of $ZnSO_4$, 45~600 g/l of $K_4P_2O_7$, 3~100 g/l of KF, 2~130 g/l of $Na_2CO_3$, and 0.5~58 g/l of $KNaC_4H_4O_6$, with additives.

In addition, in the method of the present invention, the copper plating layer may be formed by sequentially conducting first copper cyanide plating and second copper pyrophosphate ($CuP_2O_7$) plating or third copper sulfate plating, on the magnesium alloy pretreatment layer.

In addition, in the method of the present invention, the $KNaC_4H_4O_6$, added to continuously maintain the adhesion among the components of the plating pretreatment solution, may be used in an amount of 10 vol % or less, due to a sensitive substitution reaction, based on the volume of the solution of the dry bath.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a detailed description will be given of a method of preparing a copper plating layer having high adhesion to a magnesium alloy through electroplating according to the present invention, with reference to the appended drawings.

Figure 1:
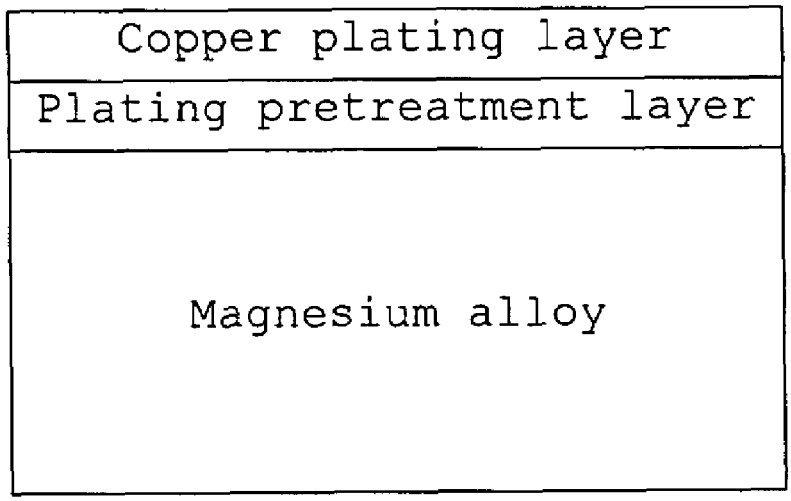
FIG. 1 is a cross-sectional view showing a copper plating layer formed using a process of preparing a copper plating layer having high adhesion to a magnesium alloy through electroplating, according to the present invention.
Figure 2:
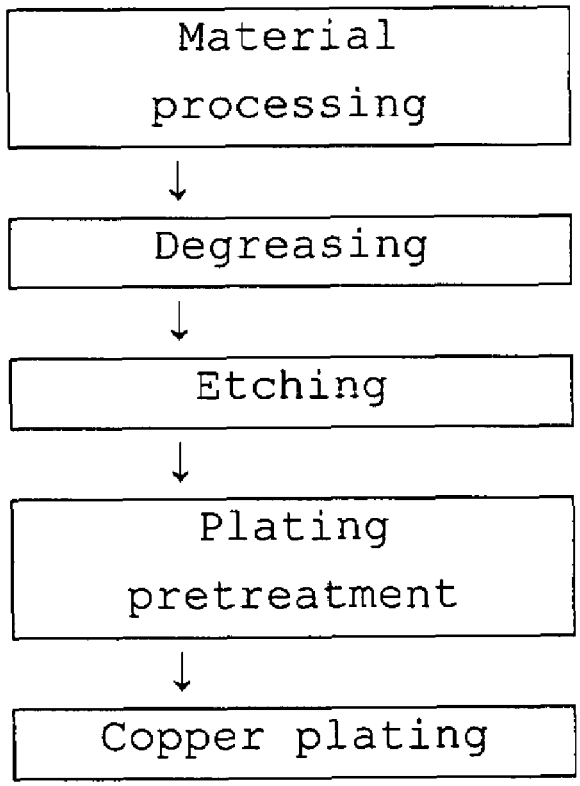
FIG. 2 is a view showing the process of preparing a copper plating layer having high adhesion to a magnesium alloy through electroplating, according to the present invention.
Figure 3:
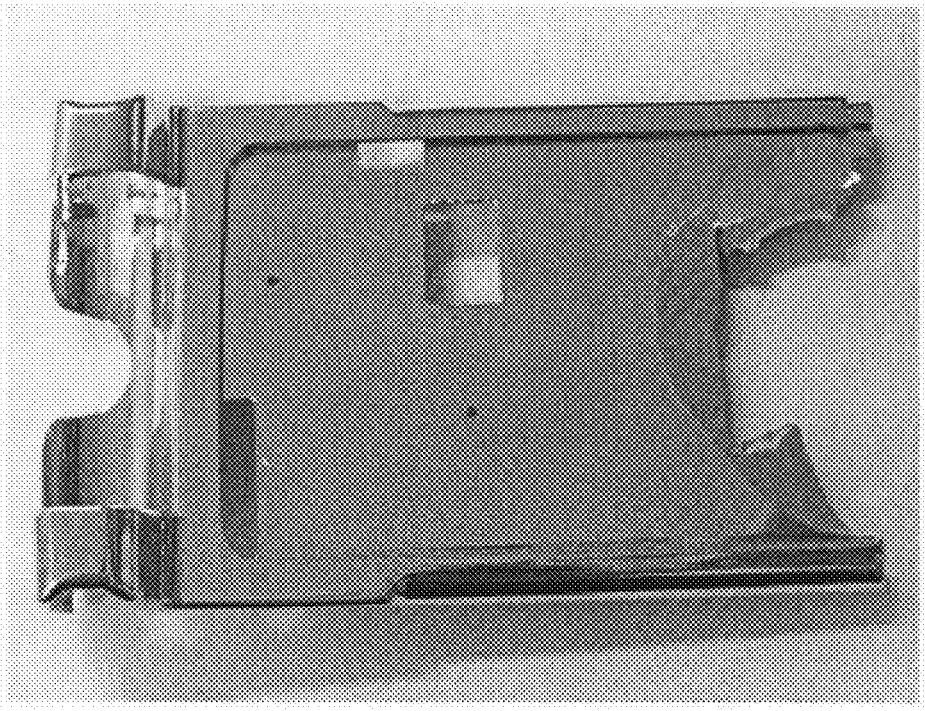
FIG. 3 is a photograph showing a state of a copper plating layer being forcibly separated from a magnesium sample, which is pretreated and then plated with copper according to a conventional technique (using conditions other than the conditions of the present invention)
Figure 4:
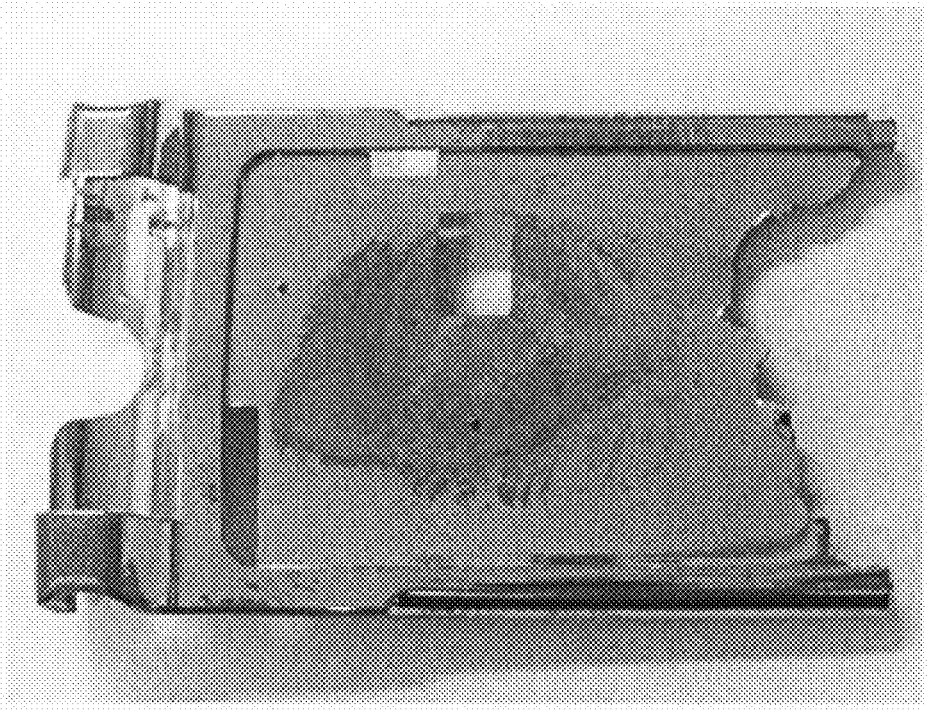
Prior Art Fig. 4
FIG. 4 is a photograph showing a state of the copper plating layer being forcibly separated from a magnesium sample, which is pretreated and then plated with copper according to the present invention.
Figure 5:
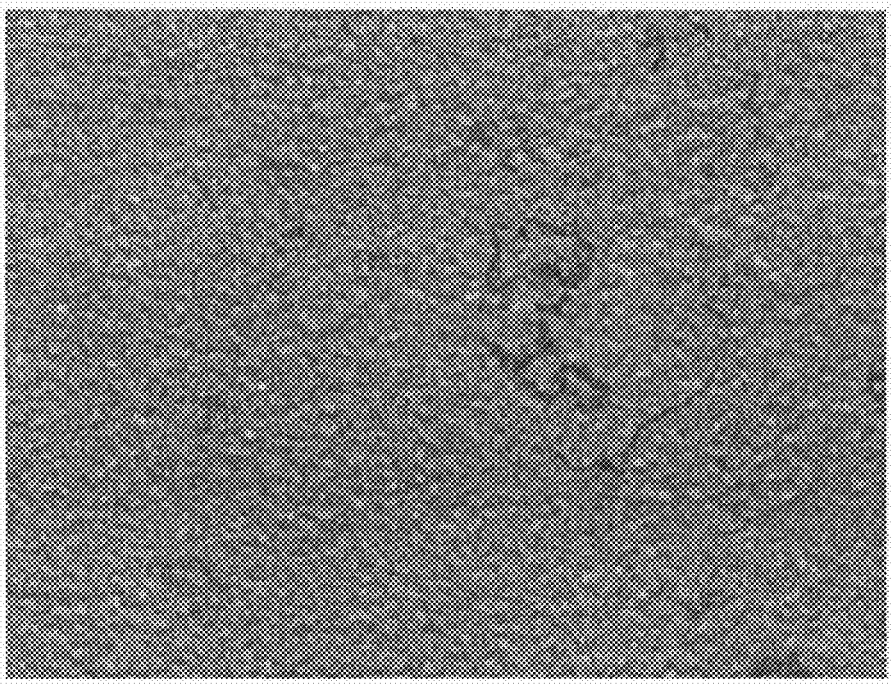
FIG. 5 is a 60-times-magnified photograph showing the surface of magnesium, which is pretreated according to the conventional technique (using conditions other than the conditions of the present invention)
Figure 6:
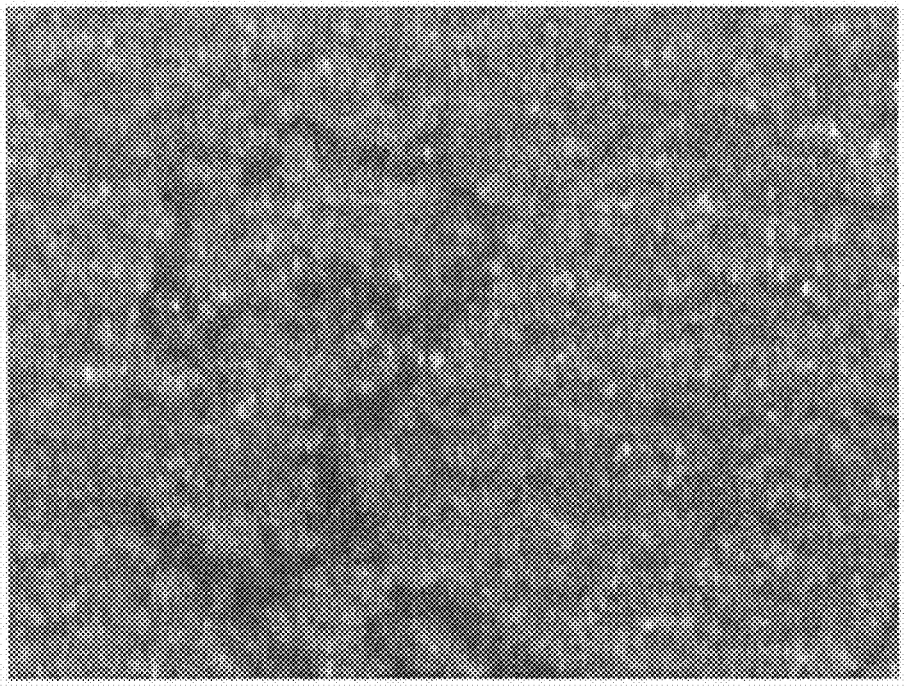
Prior Art Fig. 6
FIG. 6 is a 200-times-magnified photograph showing the surface of magnesium, which is pretreated according to the conventional technique (using conditions other than the conditions of the present invention)
Figure 7:
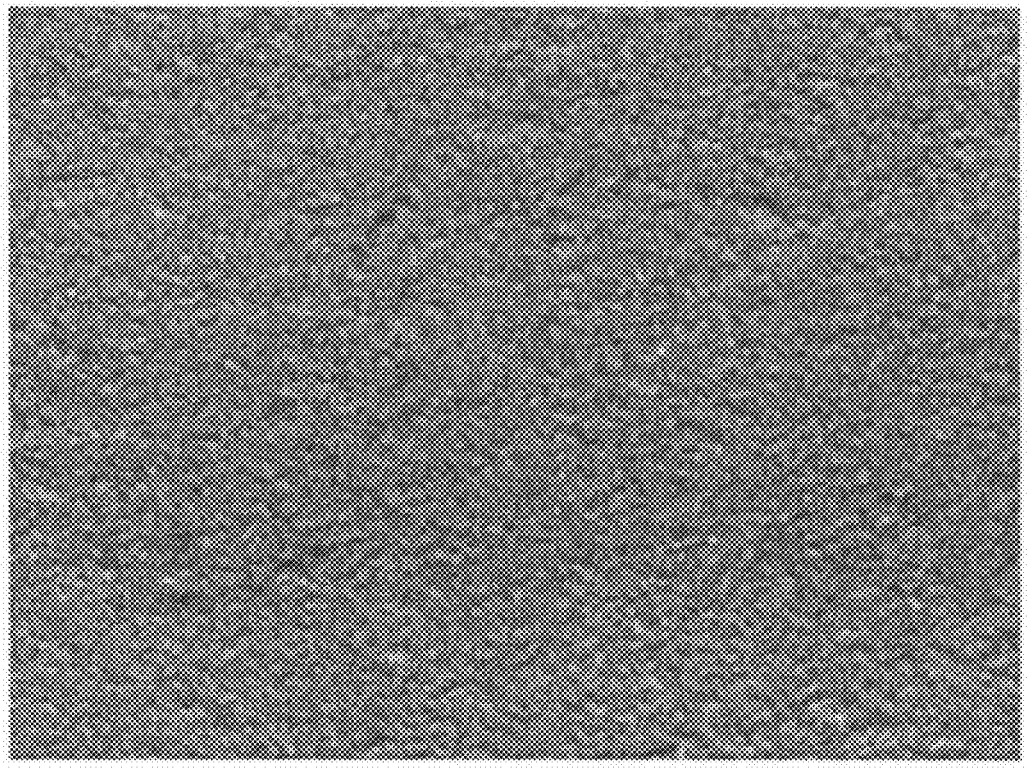
FIG. 7 is a 60-times-magnified photograph showing the surface of magnesium, which is pretreated according to the present invention.
Figure 8:
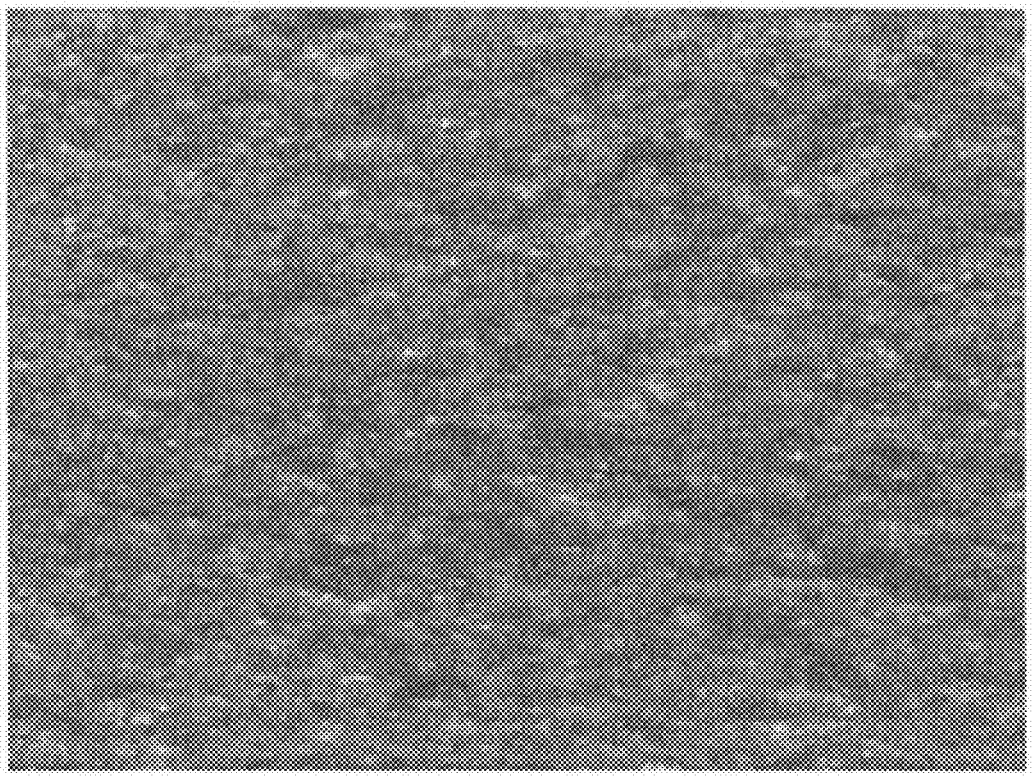
FIG. 8 is a 200-times-magnified photograph showing the surface of magnesium, which is pretreated according to the present invention.
Figure 9:
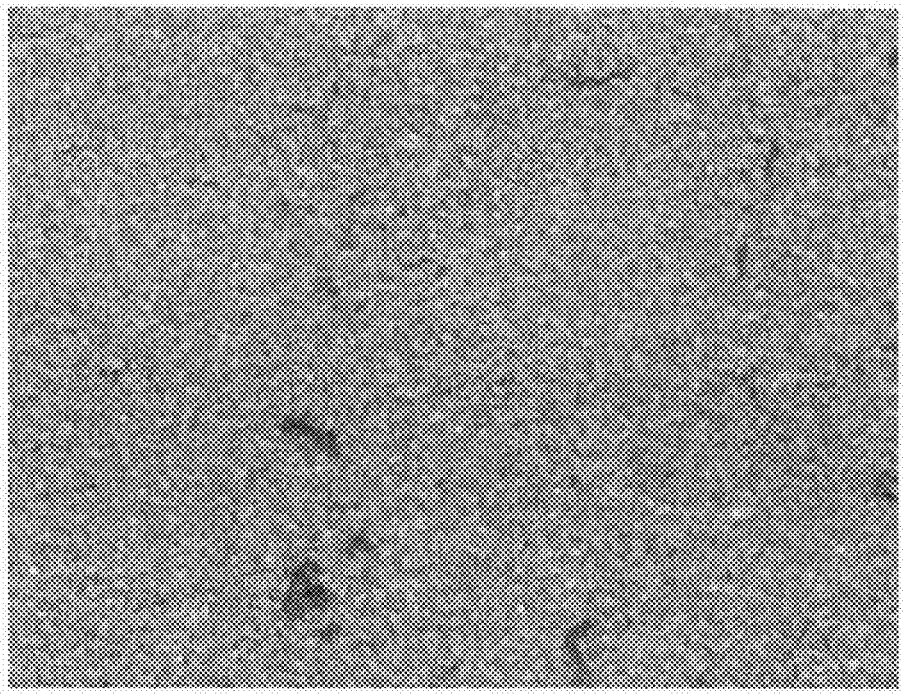
FIG. 9 is a 60-times-magnified photograph showing the pretreated surface of magnesium, resulting from forcibly separating the copper plating layer from the magnesium sample, which is pretreated and then plated with copper according to the conventional technique (using conditions other than the conditions of the present invention)
Figure 10:
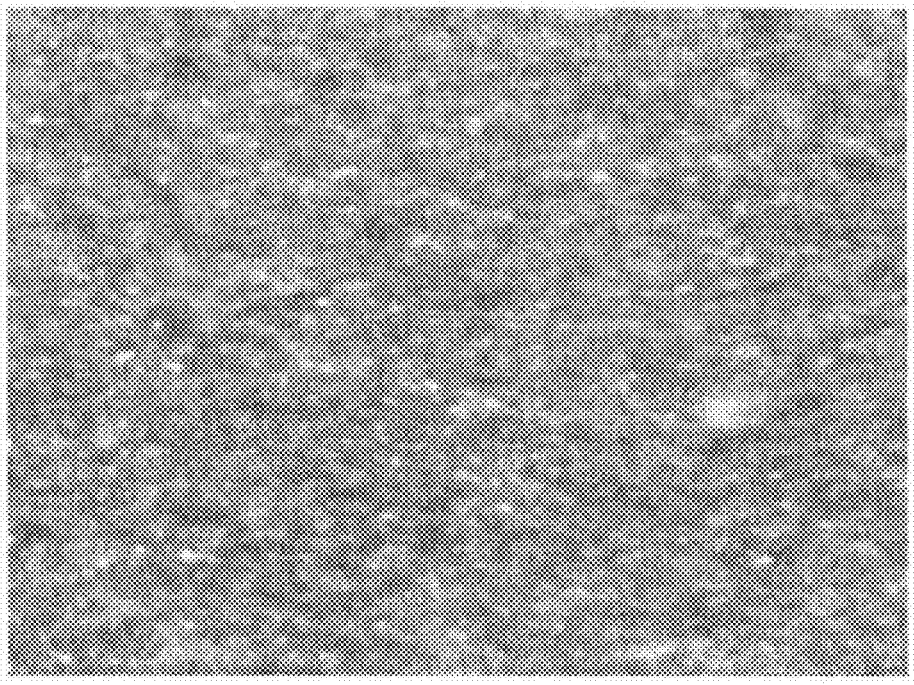
Prior Art Fig. 10
FIG. 10 is a 200-times-magnified photograph showing the pretreated surface of magnesium, resulting from forcibly separating the copper plating layer from the magnesium sample, which is pretreated and then plated with copper according to the conventional technique (using conditions other than the conditions of the present invention)
Figure 11:
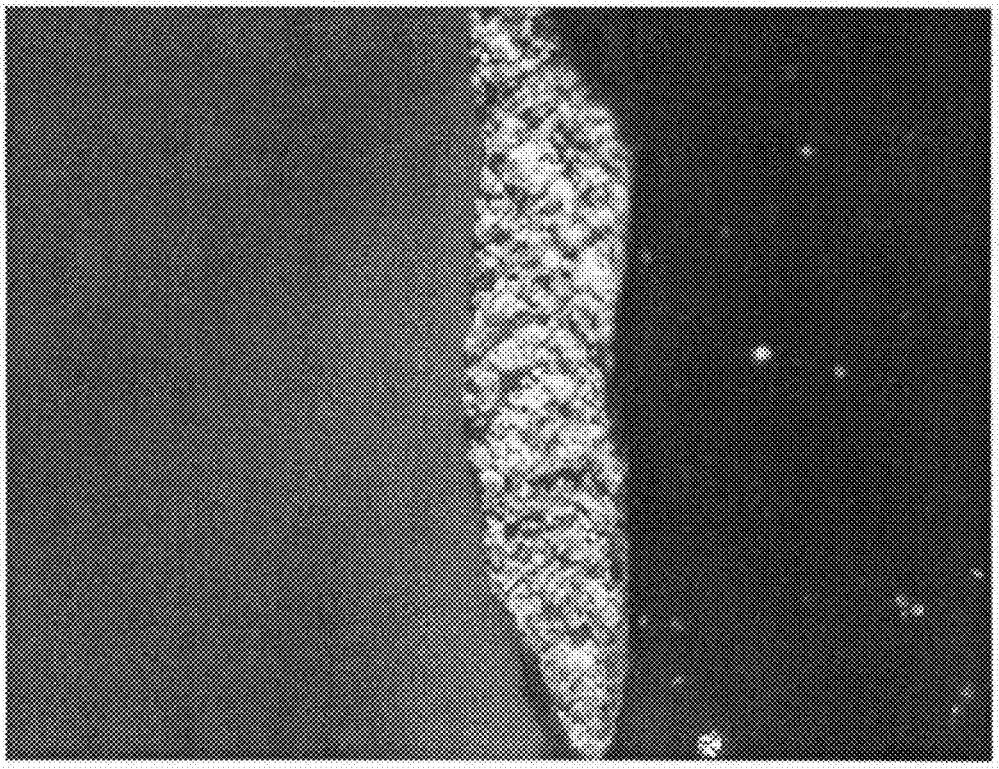
FIG. 11 is a 60-times-magnified photograph showing the pretreated surface of magnesium, resulting from forcibly separating the copper plating layer from the magnesium sample, which is pretreated and then plated with copper according to the present invention.
Figure 12:
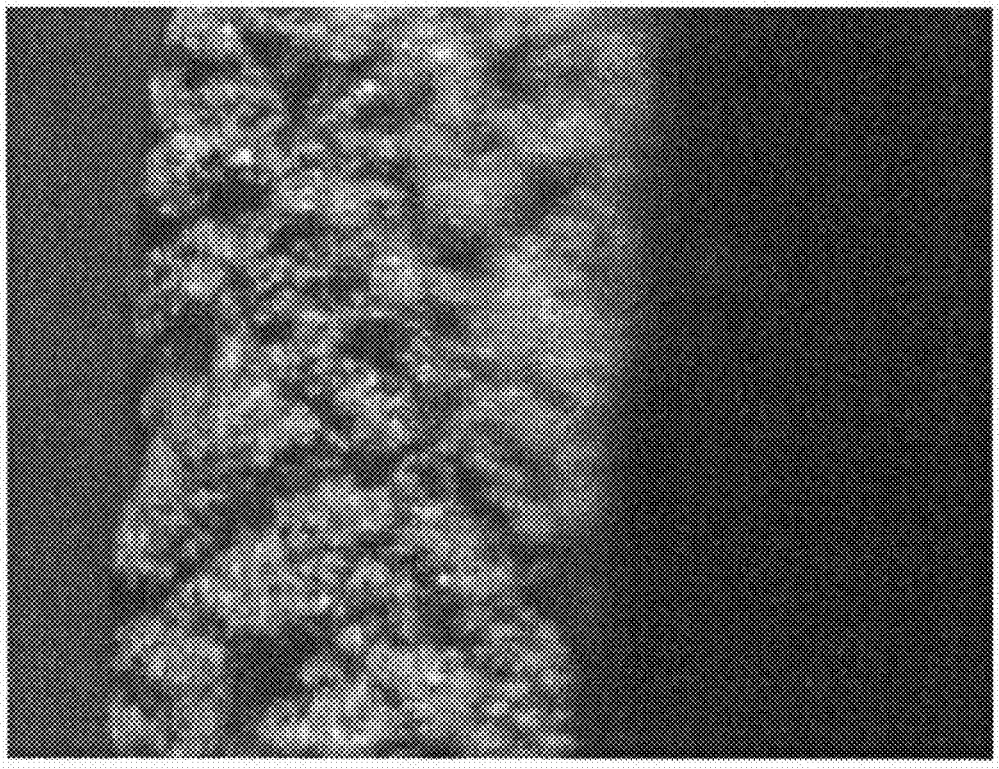
FIG. 12 is a 200-times-magnified photograph showing the pretreated surface of magnesium, resulting from forcibly separating the copper plating layer from the magnesium sample, which is pretreated and then plated with copper according to the present invention.
Figure 13:
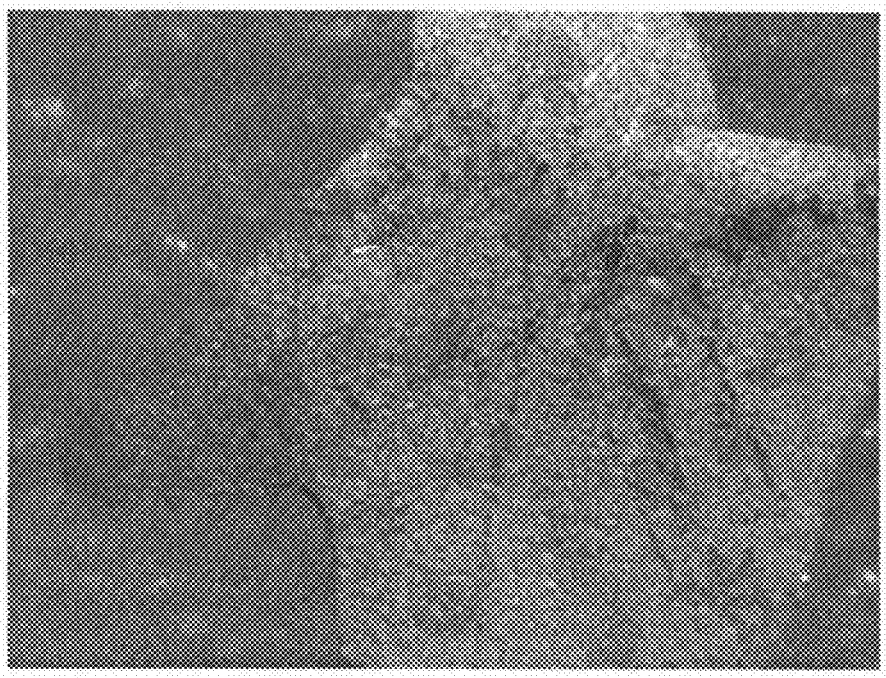
FIG. 13 is a 60-times-magnified photograph showing the surface of the copper plating layer, resulting from forcibly separating the copper plating layer from the magnesium sample, which is pretreated and then plated with copper according to the conventional technique (using conditions other than the conditions of the present invention)
Figure 14:
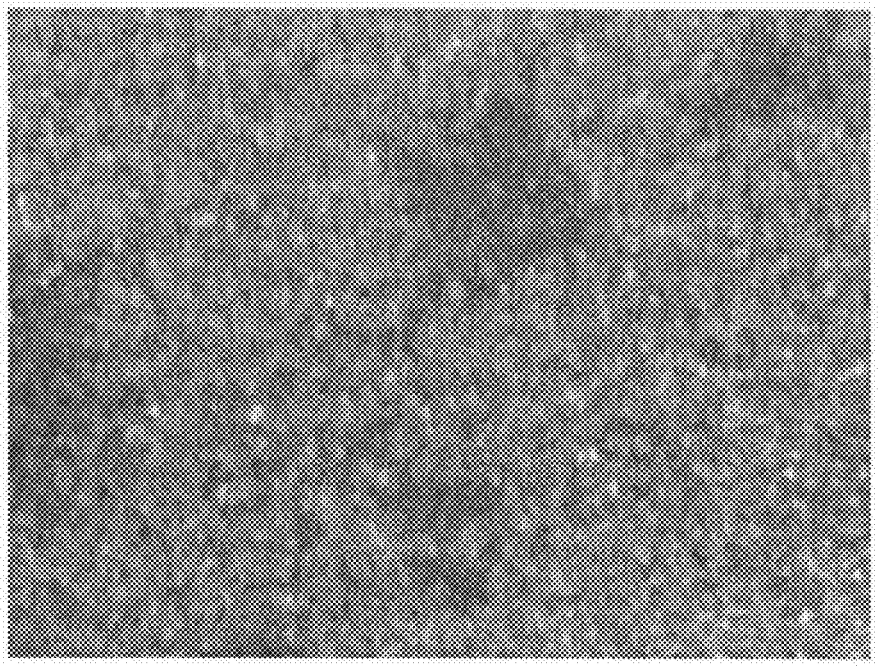
Prior Art Fig. 14
FIG. 14 is a 200-times-magnified photograph showing the surface of the copper plating layer, resulting from forcibly separating the copper plating layer from the magnesium sample, which is pretreated and then plated with copper according to the conventional technique (using conditions other than the conditions of the present invention)
Figure 15:
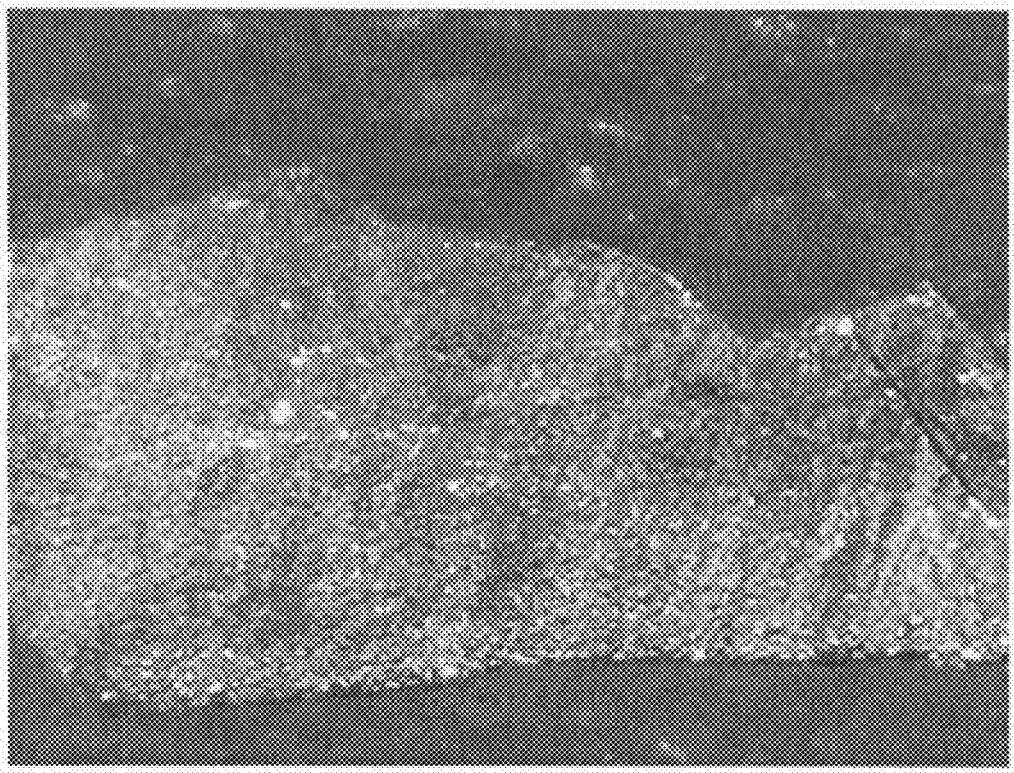
FIG. 15 is a 60-times-magnified photograph showing the surface of the copper plating layer, resulting from forcibly separating the copper plating layer from the magnesium sample, which is pretreated and then plated with copper according to the present invention.
Figure 16:
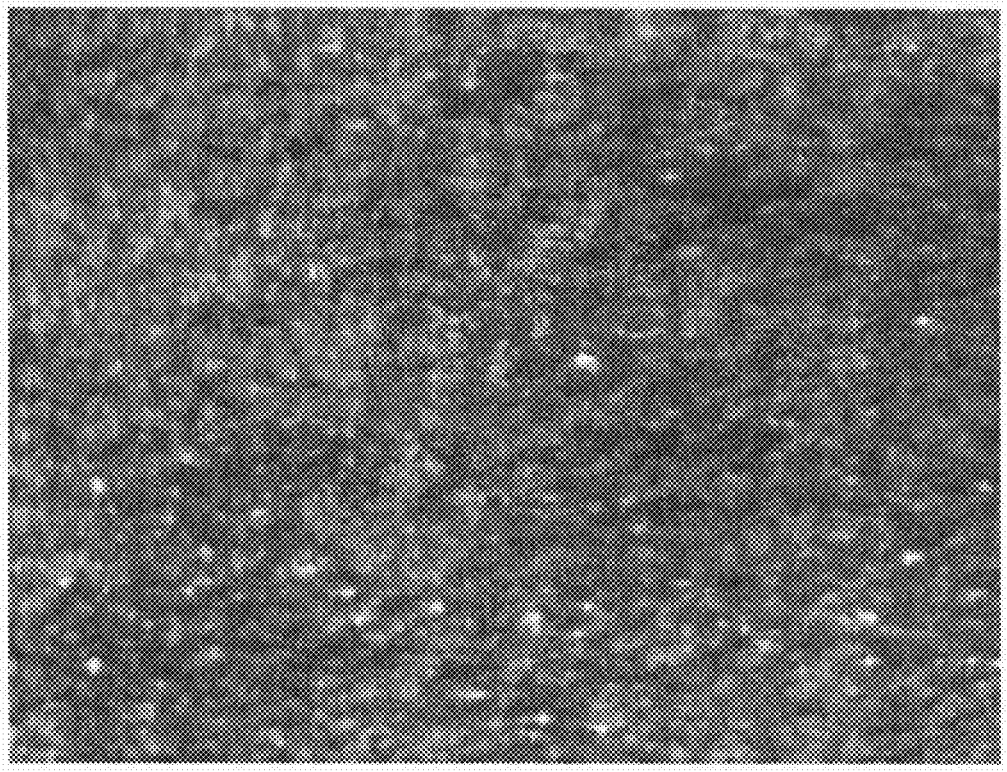
FIG. 16 is a 200-times-magnified photograph showing the surface of the copper plating layer, resulting from forcibly separating the copper plating layer from the magnesium sample, which is pretreated and then plated with copper according to the present invention.

FIG. 1 is a cross-sectional view showing a copper plating layer formed through electroplating according to a method of pretreating the magnesium alloy for electroplating of the magnesium alloy of the present invention, and FIG. 2 is a view sequentially showing a process of preparing a copper plating layer according to the method of pretreating the magnesium alloy for electroplating of the magnesium alloy of the present invention. FIG. 3 is a photograph showing the state of the copper plating layer being forcibly separated from a magnesium sample, which is pretreated and then plated with copper according to a conventional technique (using conditions other than the conditions of the present invention), and FIG. 4 is a photograph showing the state of the copper plating layer being forcibly separated from a magnesium sample, which is pretreated and then plated with copper under the conditions of the present invention. FIG. 5 is a 60-times-magnified photograph showing the surface of magnesium, which is pretreated according to the conventional technique (using conditions other than the conditions of the present invention), FIG. 6 is a 200-times-magnified photograph showing the surface of magnesium, which is pretreated according to the conventional technique (using conditions other than the conditions of the present invention), FIG. 7 is a 60-times-magnified photograph showing the surface of magnesium, which is pretreated under the conditions of the present invention, and FIG. 8 is a 200-times-magnified photograph showing the surface of magnesium, which is pretreated under the conditions of the present invention. FIG. 9 is a 60-times-magnified photograph showing the pretreated surface of magnesium, resulting from forcibly separating the copper plating layer from the magnesium sample, which is pretreated and then plated with copper according to the conventional technique (using conditions other than the conditions of the present invention), FIG. 10 is a 200-times-magnified photograph showing the pretreated surface of magnesium, resulting from forcibly separating the copper plating layer from the magnesium sample, which is pretreated and then plated with copper according to the conventional technique (using conditions other than the conditions of the present invention), FIG. 11 is a 60-times-magnified photograph showing the pretreated surface of magnesium, resulting from forcibly separating the copper plating layer from the magnesium sample, which is pretreated and then plated with copper under the conditions of the present invention, and FIG. 12 is a 200-times-magnified photograph showing the pretreated surface of magnesium, resulting from forcibly separating the copper plating layer from the magnesium sample, which is pretreated and then plated with copper under the conditions of the present invention. FIG. 13 is a 60-times-magnified photograph showing the surface of the copper plating layer, resulting from forcibly separating the copper plating layer from the magnesium sample, which is pretreated and then plated with copper according to the conventional technique (using conditions other than the conditions of the present invention), FIG. 14 is a 200-times-magnified photograph showing the surface of the copper plating layer, resulting from forcibly separating the copper plating layer from the magnesium sample, which is pretreated and then plated with copper according to the conventional technique (using conditions other than the conditions of the present invention), FIG. 15 is a 60-times-magnified photograph showing the surface of the copper plating layer, resulting from forcibly separating the copper plating layer from the magnesium sample, which is pretreated and then plated with copper under the conditions of the present invention, and FIG. 16 is a 200-times-magnified photograph showing the surface of the copper plating layer, resulting from forcibly separating the copper plating layer from the magnesium sample, which is pretreated and then plated with copper under the conditions of the present invention.

As shown in FIG. 1, a magnesium alloy sheet can be directly plated with copper (Cu) using a wet process. Since the magnesium alloy is highly corroded by an acid, it is difficult to plate. Further, the magnesium alloy is very sensitive to a pretreatment process (degreasing, acid washing, activation), as well as the copper plating process.

Of the pretreatment, the activation process greatly affects adhesion and uniformity of a copper plating layer to be subsequently formed. Thus, in order to form a uniform copper plating layer highly adhering to the magnesium alloy, the pretreatment process must be precisely conducted along with the use of a certain copper plating solution. That is, a water washing process must be thoroughly conducted at each step. Otherwise, the pre-process solution mixed with a subsequent process solution hinders an electrochemical plating process, thus undesirably causing poor plating properties.

Unlike a conventional copper plating solution, in the present invention, a copper plating solution for use in formation of a copper plating layer, having high adhesion to the magnesium alloy, comprises a weak acidic aqueous solution composed mainly of copper cyanide, sodium cyanide, copper sulfate, and sulfuric acid with additives. Using such an aqueous solution, the surface of the magnesium alloy is wet plated with copper. As such, the shape of the magnesium alloy is not limited.

As shown in FIG. 2, illustrating the copper plating process according to the method of pretreating the magnesium alloy for electroplating of the magnesium alloy of the present invention, the magnesium alloy is processed using a die casting process, degreased, etched to increase the adhesion, and then pretreated for copper plating. The pretreatment process of the magnesium alloy is very important for conducting the copper plating process on the magnesium alloy. The copper plating process includes two or three plating steps to form a desired copper plating layer.

As shown in FIG. 3 which is a photograph showing the state of the copper plating layer being forcibly separated from the magnesium sample, which is pretreated and then plated with copper according to the conventional technique (using conditions other than the conditions of the present invention), the magnesium alloy sheet (having a pretreatment layer formed on the surface thereof) plated with copper is torn, so that the copper plating layer is forcibly separated from the magnesium alloy sheet. As such, due to the low adhesion between the copper plating layer and the magnesium alloy pretreatment layer, a considerably large portion of the copper plating layer is removed from the magnesium alloy pretreatment layer. This is because the pretreatment process is conducted under conditions other than the conditions of the present invention, resulting in remarkably low adhesion between the magnesium alloy and the copper plating layer.

As shown in FIG. 4, which is a photograph showing the state of the copper plating layer being forcibly separated from the magnesium sample, which is pretreated and then plated with copper under the conditions of the present invention, although the magnesium alloy sheet is torn along with the copper plating layer, the copper plating layer has difficulty in being separated from the magnesium alloy pretreatment layer. This is because the pretreatment process conducted under the conditions of the present invention results in greatly increased adhesion.

FIG. 5 is a 60-times-magnified photograph showing the surface of the magnesium alloy pretreatment layer according to the conventional technique (using conditions other than the conditions of the present invention), and FIG. 6 is a 200-times-magnified photograph showing the surface of the magnesium alloy pretreatment layer according to the conventional technique (using conditions other than the conditions of the present invention). As shown in these drawings, many pinholes may be formed in the surface, and the state of the surface is poor due to the presence of impurities. Since such pinholes may be formed by an insufficient water washing process or inappropriate bath conditions, the generation thereof may be prevented using appropriate plating conditions and additives.

FIG. 7 is a 60-times-magnified photograph showing the surface of the magnesium alloy pretreatment layer formed under the conditions of the present invention, and FIG. 8 is a 200-times-magnified photograph showing the surface of the magnesium alloy pretreatment layer formed under the conditions of the present invention. As is apparent from these drawings, pinholes, which have been seen in FIGS. 5 and 6, are not found. However, all the pretreatment layers of FIGS. 5 to 8 are confirmed to have similar surface roughness.

FIG. 9 is a 60-times-magnified photograph showing the surface of the magnesium alloy pretreatment layer after the copper plating layer is forcibly removed from the magnesium sample, which is pretreated and then plated with copper according to the conventional technique (using conditions other than the conditions of the present invention), and FIG. 10 is a 200-times-magnified photograph showing the pretreated surface of the magnesium alloy pretreatment layer after the copper plating layer is forcibly removed from the magnesium sample, which is pretreated and then plated with copper according to the conventional technique (using conditions other than the conditions of the present invention). In FIG. 9, a plurality of pinholes is found in the magnesium alloy pretreatment layer, and there is no evidence that the copper plating layer firmly adheres to the magnesium alloy pretreatment layer. In addition, yellow copper, present on the surface of the magnesium alloy pretreatment layer, indicates that copper oxide is formed attributable to the inappropriate plating bath conditions. Such copper oxide has no conductivity and thus functions to hinder the plating process, and therefore the plating bath conditions must be carefully controlled. Consequently, it appears that the plating layer does not firmly adhere to the magnesium alloy pretreatment layer. If the copper plating layer firmly adheres to the magnesium alloy pretreatment layer, such a magnesium alloy layer should be separated along with the copper plating layer upon removal of the copper plating layer. However, as seen in FIGS. 9 and 10, the magnesium alloy layer, which is separated along with the copper plating layer as it is attached to the copper plating layer, is only slightly observed. Thus, it is believed that an adhering process is not conducted as desired.

FIG. 11 is a 60-times-magnified photograph showing the surface of the magnesium alloy pretreatment layer after the copper plating layer is forcibly removed from the magnesium sample, which is pretreated and then plated with copper under the conditions of the present invention, and FIG. 12 is a 200-times-magnified photograph showing the surface of the magnesium alloy pretreatment layer after the copper plating layer is forcibly removed from the magnesium sample, which is pretreated and then plated with copper under the conditions of the present invention. From the results of FIGS. 11 and 12, upon the forced separation of the copper plating layer, because there is high adhesion between the copper plating layer and the magnesium alloy pretreatment layer and the magnesium alloy pretreatment layer is relatively weaker than the copper plating layer, the separation is generated along through the magnesium alloy pretreatment layer. Furthermore, in FIGS. 9 and 11, relative strengths of force, applied to compulsively separate the copper plating layer, are greatly different from each other, which can be confirmed from the surface of the separated magnesium alloy layer. Although the magnesium alloy pretreatment layers of FIGS. 5 to 8 have similar surface roughness with the exception of some pinholes and defect rates, the magnesium alloy layers of FIGS. 9 to 11 have different surface roughness. That is, large crystal grains are observed in FIGS. 11 and 12, whereas they are not observed in FIGS. 9 and 10. This is because when the copper plating layer firmly adheres to the magnesium alloy layer through the pretreatment of the present invention, $Na_2Cu(CN)_3$ of the copper plating layer, having high affinity to the magnesium alloy, is formed on the surface of the pretreatment layer, thus exhibiting excellent adhesion. In addition, the reason why the large crystal grains protrude is that the grain size of $Na_2Cu(CN)_3$ is large and the separation is generated along through the pretreatment layer, thereby exposing the surfaces of the grains of $Na_2Cu(CN)_3$, upon the separation of the copper plating layer by force.

FIG. 13 is a 60-times-magnified photograph showing the surface of the copper plating layer after being forcibly removed from the magnesium sample, which is pretreated and then plated with copper according to the conventional technique (using conditions other than the conditions of the present invention), and FIG. 14 is a 200-times-magnified photograph showing the surface of the copper plating layer after being forcibly removed from the magnesium sample, which is pretreated and then plated with copper according to the conventional technique (using conditions other than the conditions of the present invention). As shown in the enlarged surface of the copper plating layer that has been attached to the pretreated magnesium alloy, there is no attachment of the magnesium alloy layer to the copper plating layer from the judgment of the exposed copper plating layer. Hence, it is confirmed that the copper plating layer has low adhesion to the magnesium alloy.

FIG. 15 is a 60-times-magnified photograph showing the surface of the copper plating layer after being forcibly removed from the magnesium sample, which is pretreated and then plated with copper under the conditions of the present invention, and FIG. 16 is a 200-times-magnified photograph showing the surface of the copper plating layer after being forcibly removed from the magnesium sample, which is pretreated and then plated with copper under the conditions of the present invention. Compared to the photographs shown in FIGS. 13 and 14, from the results of FIGS. 15 and 16, it can be seen that the magnesium alloy layer is attached to almost the entire surface of the copper plating layer. As such, the surface of the magnesium alloy adhering to the copper plating layer forcibly separated exhibits large grains contained in the pretreatment layer. This indicates that the pretreated magnesium alloy layer is removed from the magnesium alloy sheet.

A better understanding of the present invention may be obtained in light of the following examples, which are set forth to illustrate, but are not to be construed to limit the present invention.

EXAMPLE 1

A magnesium alloy was processed through die casting, dipped into a degreasing solution at 30~90° C., allowed to stand in the solution at about 10 pH for 10 min to remove all oil components, and then washed with water to completely eliminate the degreasing solution component. As such, if a very small amount of the degreasing solution component remains, an electrochemical reaction rate is decreased upon plating, thus causing undesirable expansion of the surface and formation of pinholes, resulting in decreased adhesion between a base metal and a plating layer. Thus, thorough water washing must be conducted.

An aqueous solution having the composition shown in Table 1 below was prepared, the temperature thereof was adjusted, and a dipping process was conducted using such an aqueous solution. The temperature of the aqueous solution, the dipping time and the pH are given in Table 1 below.

TABLE 1

| Composition of Aqueous Solution | Temp. of Aqueous Solution (° C.) | Dipping Time (min) | pH |
|---|---|---|---|
| $ZnSO_4 + Na_4P_2O_7 + KF + Na_2CO_3$ | 30~90 | 1~20 | 1~14 |

In addition, an aqueous solution having the composition shown in Table 2 below was prepared, the temperature thereof was adjusted, and a dipping process was conducted using the aqueous solution. The temperature of aqueous solution, the dipping time and the pH are given in Table 2 below.

TABLE 2

| Composition of Aqueous Solution | Temp. of Aqueous Solution (° C.) | Dipping Time (min) | pH |
|---|---|---|---|
| $ZnSO_4 + K_4P_2O_7 + NaF + Na_2CO_3 + KNaC_4H_4O_6$ | 20~90 | 1~20 | 0.5~14 |

In addition, an aqueous solution having the composition shown in Table 3 below was prepared, the temperature thereof was adjusted, and a dipping process was conducted in the aqueous solution. The temperature of aqueous solution, the dipping time and the pH are given in Table 3 below.

TABLE 3

| Composition of Aqueous Solution | Temp. of Aqueous Solution (° C.) | Dipping Time (min) | pH |
|---|---|---|---|
| $ZnSO_4 + K_4P_2O_7 + KF + Na_2CO_3$ | 18~90 | 1~20 | 0.3~14 |

When the chemical components used had fatigue due to frequent plating, each of $K_4P_2O_7$ and $Na_2CO_3$ was added in an amount of about 5~20 vol % based on the volume of the solution of a dry bath so as to continuously maintain adhesion.

Since the magnesium alloy, which is a composite material, is very sensitive to the copper plating process, the magnesium alloy must be pretreated under the conditions of the present invention.

As such, it should be noted that $KNaC_4H_4O_6$ causes a sensitive substitution reaction even though it is added in a very small amount, and thus should be used in an amount not higher than 10 vol % based on the volume of the solution of the bath.

In the present invention, upon electroplating of the magnesium alloy, the pretreatment solution is formed to have NaF instead of KF, and $K_4P_2O_7$ instead of $Na_4P_2O_7$, with a small amount of $KNaC_4H_4O_6$, and thereby the copper plating layer may have high adhesion even though the chemical components in the dry bath have fatigue.

The magnesium alloy having a film thereon through the plating pretreatment conditions shown in Tables 1 to 3 is electroplated to form a copper plating layer. In addition, before the plating pretreatment, a water bath at 80~90° C. may be applied depending on the properties of products, and thus the plating pretreatment time may be shortened.

Upon copper plating, copper cyanide plating is first conducted to increase adhesion of a base metal. Using the following aqueous solution, temperature, voltage, current and conductive time are controlled to form a copper cyanide plating layer.

The copper cyanide plating process is conducted to firmly attach the copper cyanide plating layer to the magnesium alloy pretreatment layer. Thus, the copper cyanide ($Na_2Cu(CN)_3$) plating layer is formed to securely adhere to the magnesium alloy pretreatment layer.

| Composition of Aqueous Solution | Temp. of Aqueous Solution (° C.) | Voltage (V) | Current (A/dm2) | Conducting Time (min) | pH |
|---|---|---|---|---|---|
| $CuCN + NaCN + Na_2CO_3$ | 25~35 | 2~4 | 3~5 | 1~5 | 9~10 |

After the copper cyanide plating layer is formed, copper pyrophosphate ($CuP_2O_7$) plating and then copper sulfate plating may be selectively conducted to remove pinholes.

Since the copper cyanide plating layer is formed on the rough surface of the magnesium alloy having many pinholes, copper pyrophosphate ($CuP_2O_7$) plating is conducted, in order to fill the pinholes and flatten the surface. Further, the sulfate copper plating may be selectively conducted to fill the pinholes and flatten he surface.

The copper cyanide grains are very large and rough, which can be indirectly confirmed from the photograph of the separated magnesium alloy pretreatment layer as in FIG. 12.

The copper sulfate plating is conducted using the following aqueous solution while controlling the temperature, voltage, current, and conductive time, to form a copper sulfate plating layer.

| Composition of Aqueous Solution | Temp. of Aqueous Solution (° C.) | Voltage (V) | Current ($A/dm^2$) | Conducting Time (min) | pH |
|---|---|---|---|---|---|
| $CuSO_4 + H_2SO_4 +$ Chlorine Ion $+ Na_2CO_3$ | 30~50 | 4~6 | 5~8 | 1~5 | 9~10 |

Therefore, the copper plating process actually includes two or three steps, in which copper cyanide plating is first conducted on the pretreated surface of the magnesium alloy and then selectively, copper pyrophosphate ($CuP_2O_7$) plating and then copper sulfate plating may be conducted.

TABLE 4

| | Sample | Adhesion: File Test | Adhesion: Tape Test | Pencil Lead Test (H) |
|---|---|---|---|---|
| Ex. No. | 1 | ○ | ○ | 4 |
| | 2 | ○ | ○ | 4 |
| | 3 | ○ | ○ | 4 |
| | 4 | ○ | ○ | 4 |
| | 5 | ○ | ○ | 4 |
| | 6 | ○ | ○ | 4 |
| | 7 | ○ | ○ | 4 |

Note:
○: excellent,
Δ: normal,
X: easy separation

Table 4 shows the results of file test, tape test and pencil lead test of a magnesium sample, which is pretreated and then plated with copper under normal conditions. All the samples of Examples 1~7 can be seen to have uniform gloss without color spread.

According to general test procedures, the magnesium alloy sheet having a plating layer was scratched in a 1×1 mm sized lattice form using a tungsten blade such that the plating layer was cut along with the magnesium alloy sheet, after which tape was firmly attached to the entire surface of the sheet and then detached therefrom. As the result, no separation was observed.

In addition, a pencil lead test which is used to test the strength of the surface was conducted in a manner such that a pencil available from Mitsubishi having hardness of 4 H was sharpened and drawn while being pressed on the surface plated with copper under uniform load. Then, when the lead of the pencil was broken without scratches of the surface, the surface strength was measured. All the samples were passed through the test. The surface strength was found to be 200 H in the present invention.

In a file test, the plating sample was vertically cut, held and then filed at 45° to the plating surface. While the sample was filed along with the plating film, whether or not the plating film was removed from the base sheet was measured. The results are shown in Table 4. As shown in Table 4, the samples that underwent the file test were all excellent.

TABLE 5

| 3% NaOH | Sample No. | | | | | | |
|---|---|---|---|---|---|---|---|
| Soultion | 1 | 2 | 3 | 4 | 5 | 6 | 7 |
| 1 day | ○ | ○ | ○ | ○ | ○ | ○ | ○ |
| 2 day | ○ | ○ | ○ | ○ | ○ | ○ | ○ |
| 3 day | ○ | ○ | ○ | ○ | ○ | ○ | ○ |
| 4 day | ○ | ○ | ○ | ○ | ○ | ○ | ○ |
| 5 day | ○ | ○ | ○ | ○ | ○ | ○ | ○ |

Note:
○: excellent corrosion resistance
X: easy corrosion

As is apparent from Table 5, the test samples were colored under normal conditions of the present invention, and dipped into a 3% NaOH aqueous solution to confirm corrosion resistance. All seven samples were uncorroded, without any changes in gloss or color.

TABLE 6

| 5% NaCl | Sample No. | | | | | | |
|---|---|---|---|---|---|---|---|
| Soultion | 1 | 2 | 3 | 4 | 5 | 6 | 7 |
| 1 day | ○ | ○ | ○ | ○ | ○ | ○ | ○ |
| 2 day | ○ | ○ | ○ | ○ | ○ | ○ | ○ |
| 3 day | ○ | ○ | ○ | ○ | ○ | ○ | ○ |
| 4 day | ○ | ○ | ○ | ○ | ○ | ○ | ○ |
| 5 day | ○ | ○ | ○ | ○ | ○ | ○ | ○ |

Note:
○: excellent corrosion resistance
X: easy corrosion

Table 6 shows the results of corrosion resistance test by dipping samples into a 5% NaCl aqueous solution. As a result, all seven samples were uncorroded, without any changes in gloss or color.

As described above, the present invention provides a method of preparing a copper plating layer having high adhesion to a magnesium alloy through electroplating. According to the present invention, after the magnesium alloy is pretreated for electroplating, a copper (Cu) electroplating process is conducted, thereby obtaining an electrically uniform current distribution. In addition, the plating layer having uniform and excellent adhesion is formed, and thus, the magnesium alloy, which is susceptible to an acid, in particular, an aqueous sodium chloride solution, has drastically increased corrosion resistance, therefore further increasing the usability of the magnesium alloy. Moreover, the adhesion between the pretreated magnesium alloy layer and the copper plating layer can be increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preparing a copper plating layer having high adhesion to a magnesium alloy through electroplating, comprising:

pretreating the magnesium alloy with a plating pretreatment solution to form a film for electroplating, serving as a magnesium alloy pretreatment layer, exhibiting a uniform current distribution; and conducting copper electroplating on the magnesium alloy pretreatment layer to form the copper plating layer firmly adhering to the magnesium alloy pretreatment layer, wherein, if the copper plating layer is removed by force, the surface of the magnesium alloy adhering to the copper plating layer exhibits coarse grains contained in the pretreatment layer, wherein the copper electroplating layer is formed by sequentially conducting on the magnesium pretreatment layer a copper cyanide electroplating; and at least one of a copper pyrophosphate ($CuP_2O_7$) electroplating and a copper sulfate electroplating.

2. The method as set forth in claim 1, wherein the plating pretreatment solution comprises 5 to 130 g/l of $ZnSO_4$, 30 to 450 g/l of $Na_4P_2O_7$, 4 to 100 g/l of KF, and 2 to 100 g/l of $Na_2CO_3$.

3. The method as set forth in claim 2, wherein each of $Na_4P_2O_7$ and $Na_2CO_3$ is used in an amount of about 5 to 20 vol % based on a volume of a solution of a dry bath when chemical components of the plating pretreatment solution have fatigue due to frequent plating, in order to continuously maintain adhesion between the copper plating layer and magnesium alloy.

4. The method as set forth in claim 1, wherein the plating pretreatment solution comprises 4 to 145 g/l of $ZnSO_4$, 15 to 450 g/l of $Na_4P_2O_7$, 1 to 125 g/l of NaF, 1 to 125 g/l of $Na_2CO_3$ and 0.5 to 45 g/l of $KNaC_4H_4O_6$, with additives.

5. The method as set forth in claim 4, wherein the $KNaC_4H_4O_6$, added to continuously maintain the adhesion among the components of the plating pretreatment solution, is used in an amount between 1 vol % and 10 vol %, due to a sensitive substitution reaction, based on the volume of the plating pretreatment solution.

6. The method as set forth in claim 1, wherein the plating pretreatment solution comprises 5 to 80 g/l of $ZnSO_4$, 4 to 380 g/l of $K_4P_2O_7$, 5 to 80 g/l of KF, and 2 to 120 g/l of $Na_2CO_3$.

7. The method as set forth in claim 1, wherein the plating pretreatment solution comprises 7 to 220 g/l of $ZnSO_4$, 45 to 600 g/l of $K_4P_2O_7$, 3 to 100 g/l of KF, 2 to 130 g/l of $Na_2CO_3$, and 0.5 to 58 g/l of $KNaC_4H_4O_6$, with additives.

8. The method as set forth in claim 7, wherein the $KNaC_4H_4O_6$, added to continuously maintain the adhesion among the components of the plating pretreatment solution, is used in an amount between 1 vol % and 10 vol %, due to a sensitive substitution reaction, based on the volume of the plating pretreatment solution.

* * * * *